United States Patent [19]

Fastenau

[11] Patent Number: 4,538,521

[45] Date of Patent: Sep. 3, 1985

[54] RECESSIBLE GUIDE RAIL ARRANGEMENT FOR A WHEEL-SUPPORTED VEHICLE

[75] Inventor: Werner Fastenau, Esslingen-Rüdern, Fed. Rep. of Germany

[73] Assignee: Ed. Züblin Aktiengesellschaft, Stuttgart, Fed. Rep. of Germany

[21] Appl. No.: 516,646

[22] Filed: Jul. 25, 1983

[30] Foreign Application Priority Data

Jul. 24, 1982 [DE] Fed. Rep. of Germany ..... 3227795

[51] Int. Cl.[3] ..... B61B 13/04

[52] U.S. Cl. ..... 104/118; 104/120

[58] Field of Search ..... 104/247, 118, 119, 120, 104/130, 1 R

[56] References Cited

U.S. PATENT DOCUMENTS

| | | | |
|---|---|---|---|
| 2,768,588 | 10/1956 | Robb | 104/120 |
| 4,221,170 | 9/1980 | Koudelka | 104/120 |

FOREIGN PATENT DOCUMENTS

| | | | |
|---|---|---|---|
| 2720385 | 11/1978 | Fed. Rep. of Germany | 104/130 |
| 3150571 | 6/1983 | Fed. Rep. of Germany . | |
| 0956994 | 4/1964 | United Kingdom | 104/247 |

*Primary Examiner*—Robert B. Reeves

*Assistant Examiner*—Dennis Rodgers

*Attorney, Agent, or Firm*—Walter Ottesen

[57] ABSTRACT

The invention is directed to a recessible guide rail for guiding a wheel-supported vehicle along a roadway structure. The vehicle is equipped with flangeless wheels or the like for coacting with a side wall of the rail to laterally guide the vehicle along the roadway structure. It is necessary to remove the guide rail from time to time in order to realize the advantages of such a vehicle on its special rail-like roadway structure and on conventional roads. With the guide rail removed, it is possible to remove the laterally guided vehicle from its roadway structure. Also, it is possible to permit other vehicles to cross the special roadway structure of the guided vehicle. With the invention, supporting devices having lateral holding pockets which can be moved in elevation are installed where the guide rail is to be removable. Straight or curved guide rail segments which can be made of steel reinforced concrete are inserted into the pockets. The supporting devices raise the guide rail segments above the roadway surface to the elevation necessary for guiding the vehicle or lower the same in an elongated recess so that the upper edges of the rail segments are flush with the roadway surface of the roadway structure.

11 Claims, 7 Drawing Figures

RECESSIBLE GUIDE RAIL ARRANGEMENT FOR A WHEEL-SUPPORTED VEHICLE

FIELD OF THE INVENTION

The invention relates to a recessible guide rail arrangement for guiding a wheel-supported vehicle along a roadway. The vehicle is laterally guided along the roadway by appropriate means such as flangeless wheels which act upon a vertical sidewall of the guide rail.

BACKGROUND OF THE INVENTION

Railroad vehicles require wheels having a flanged rim for lateral guidance. The flange glides on a side surface of the rail. On the other hand, wheel-supported vehicles having flangeless wheels for lateral guidance require vertical guide surfaces on which steering rollers having vertical rotational axes act in order to function either as a sensor to provide the desired steering information or, as a steering means per se to forcibly maintain the vehicle in its predetermined path. The guide surfaces can, for example, be provided at the edges of the roadway structure. The special roadway therefore has a trough-like shape and includes a horizontal roadway surface and two guiding surfaces arranged laterally of the latter. The guiding surfaces are defined by so-called guide rails.

If the special roadway is to be crossed at grade level as for example by a street, it is necessary in this region to be able to remove the guide rails temporarily. Since the laterally guided wheel-supported vehicle can also be manually steered without the guide rail in the manner of a conventional street vehicle, it would appear possible to temporarily remove the guide rails over a certain length of the special roadway in order to permit the egress and ingress of this guided vehicle.

With existing roadways for laterally-guided wheel-supported vehicles, the guide rails have simply been omitted at the region where conventional streets cross the special roadway. At these locations, the speed of the laterally guided vehicle must be greatly reduced. In addition, such regions without the guide rails constitute a safety hazard. Speed reductions and safety risk reduce the specific advantages of such laterally guided vehicles.

The temporary removal of the guide rails could be performed by disassembling the same in a conventional manner; however, this would be much too difficult and take too much time under normal circumstances.

Another solution would be to configure the guide rail as a gate crossing either vertical or horizontal. However, this would probably not be workable because the distance over which the guide rails would have to be removed is too great and the guide rails configured in this manner would no longer be able to take up the lateral forces developed by the guided vehicle.

The assignee of this application has for some time now been engaged in the development of special roadway configurations for laterally-guided, wheel-supported vehicles. The required dimensional accuracy of the roadway to achieve a high level of travel comfort has lead to configurations which are assembled from factory finished parts and can be compared to roadways for rail vehicles, namely roadways made up of rails and ties. From this, special requirements have been recognized which should also be met by recessible guide rails.

One solution is disclosed in DE-OS No. 31 50 571 of the assignee wherein recessible guide rails of a desired length are disclosed which are put together from a number of relatively short channel-like components arranged one behind the other. The recessible guide rail and the mechanisms needed to move the guide rail constitute a unit. Because of the mechanism which is accommodated in the profile of the guide rail, this configuration is relatively complicated and expensive.

If one starts with the premise that one of the advantages of this construction lies in being able to utilize a single unit, then guide rails are only possible wherein the total length of the guide rail is dividable by the length of the single unit. However, in practice, this limitation can cause problems. For example, it is often desired to have the possibility of putting together recessible guide rails made up of components of various lengths. Such a situation could be where the recessible guide rail is used for a portion of a switch assembly.

SUMMARY OF THE INVENTION

In view of the foregoing, it is an object of the invention to provide a recessible guide rail arrangement wherein the recessible guide rail can be adapted and configured to accommodate a dimensional requirement of the roadway structure. More specifically, it is an object of the invention to provide such an arrangement which is economical and can accommodate length and curvature requirements for the recessible guide rail as they may occur.

The recessible guide rail arrangement of the invention guides a wheel-supported vehicle in its movement along a roadway structure. The vehicle is preferably equipped with flangeless wheels or the like for coacting with a side wall of the guide rail to laterally guide the vehicle along the roadway structure. The recessible guide rail arrangement includes as a feature a plurality of guide rail segments arranged one behind the other to define the guide rail, the ends of each two mutually adjacent segments defining supporting locations of the guide rail.

The recessible guide rail can be any desired length and can be put together from individual shorter rail segments. The individual rail segments are not necessarily all the same length; rather, the lengths of the rail segments making up the recessible guide rail are selected to accommodate the requirements of the situation encountered along the roadway structure.

As a further feature of the invention, a plurality of supporting devices are mounted in a recess and are arranged at respective ones of said supporting locations along the guide rail. The supporting devices include holding means for receiving the respective end portions of the mutually adjacent rail segments therein to thereby hold and support the rail segments with respect to the roadway structure. The supporting devices include elevation means for moving the recessible guide rail between a first position whereat said guide rail is recessed in said recess and a second position whereat the guide rail is raised above the roadway surface for laterally guiding the vehicle therealong.

When the recessible guide rail made up of the individual rail segments is in the first position, it is subjected to such forces, for example, as are developed when street traffic rolls over the rail segments. In the second position, the rail segments are subjected to the forces developed by the guided vehicle which acts on the vertical side, walls of the rail segments. These forces are transferred by the supporting devices either to the roadway structure or to a special foundation.

An advantage of this configuration is that the individual moving mechanism for effecting the movement of the guide rail between its two positions is concentrated into a compact component which is referred to above and in the discussion which follows as a supporting device. These units are all the same and can therefore be economically produced.

According to a further feature of the invention, the holding means referred to above includes a structure defining two lateral pockets for receiving respective end portions of two mutually adjacent rail segments which can be of respectively different lengths. These rail segments may also be curved. It is still a further feature of the invention that these lateral pockets have upwardly facing openings whereby the rail segments may be drop-loaded thereinto from above.

Whereas the production of the supporting devices involves mechanical engineering and factory manufacturing techniques, the manufacture of the guide rail segments is simple so that this work can be performed by relatively unskilled workers and to accommodate the requirements encountered. The manufacture of the rail segments can also be performed by the operator of the transport system utilizing the laterally-guided vehicles. This is of significance when the transport system of this type is installed abroad such as in developing countries.

Of course it would be possible to secure the rail segments to lateral brackets of the supporting devices by means of screws. However, the simple insertion of the rail segments into the lateral pockets of the supporting devices provides the advantage that with this kind of a connection tolerances in length and especially changes in length brought about by changes in the temperature are taken up and can be compensated for. Otherwise, such changes in length with long components could produce substantial problems.

This very flexible connection permits straight rail segments to be arranged as a portion of a polygon to approximate a curve thereby causing each two mutually adjacent rail segments connected to a supporting device to define a small angle. The side wall of the rail segment needed for sensing the steering information can preferably be provided with a radius of curvature to correspond to the desired curve.

A further advantage of the connection of the rail segments to the supporting device as taught by the invention is that no unwanted forces will develop at the connection location should an individual supporting device malfunction so that no damage would result. The situation could well be otherwise if, for example, the rail segments would be secured to the supporting device with the aid of threaded bolts.

According to another feature of the invention, the guide rail segments are made of steel-reinforced concrete. This construction affords the advantage that the guide rail segments can easily be produced in the desired length either straight or curved and can be dimensioned as required to take up forces to which they will be subjected during actual use. With an appropriate form any number of guide rail segments can be cast. The guide rail segments made of concrete are resistant to corrosion and compare favorably to steel parts in this regard. Also, concrete segments have a very positive effect with respect to achieving quiet running of the vehicle because of their stiffness; this also results in reduced noise to the surrounding environment. The supporting device should also be used at the end of the recessible guide rail; however, in this situation, only one of the lateral pockets will accommodate a rail segment whereas the other pocket will remain unused.

The horizontal and vertical forces acting upon rail segments can be effectively taken up via the stable supporting device either by placing the supporting device on a separate foundation or, by securing the supporting device to the roadway structure as is the situation with the conventional steel guide rail segments of the building block system developed by the assignee for track-guided transport systems. It should be noted that the vertical forces can be very large when the guide rail is in the recessed position.

DESCRIPTION OF THE PREFERRED EMBODIMENTS OF THE INVENTION

Figure 2:
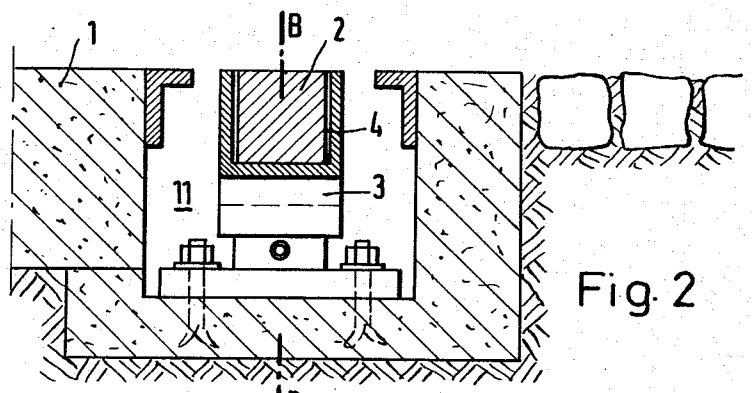
FIG. 2 is a lateral section view of the recessible guide rail taken along line A—A of FIG. 1.
Figure 1:
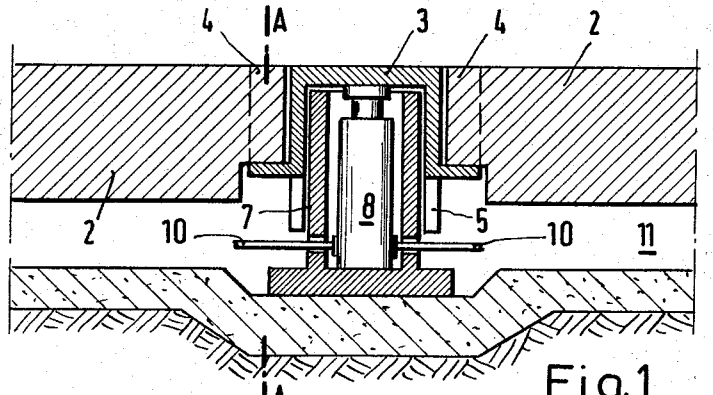
FIG. 1 is a longitudinal section view of the recessible guide rail of the invention when the guide rail is in its recessed position, the section view being taken along line B—B of FIG. 2.

Referring to FIGS. 1 and 2, reference numeral 1 indicates the roadway structure and reference numeral 1', the roadway surface upon which the wheel-supported vehicle is guided in its movement. The recessible guide rail is mounted in a recess 11 at the side of the roadway and is shown in FIGS. 1 and 2 in the recessed position. The recessible guide rail is made up of guide rail segments 2 and a plurality of supporting devices 3 of which one unit is shown.

The guide rail segments 2 are arranged one behind the other and the supporting device 3 includes holding means in the form of a movable upper structure 5 defining lateral pockets 4 into which the respective end portions of the rail segments 2 are dropped or pushed from above. The supporting device also includes a base 6. The movable upper structure 5 is movable in the vertical direction and slides on a vertical parallel guide 7 of the base 6.

The supporting device 3 further includes elevation means in the form of a hydraulic press or jack 8 to effect the vertical movement of the upper structure 5 to thereby move the recessible guide rail between a first position whereat the guide rail is recessed in its recess 11 so that the upper surface of the guide rail is flush with respect to the roadway surface and a second position whereat the guide rail is raised above the roadway surface for laterally guiding the vehicle to be guided therealong. The second or elevated position of the recessible guide rail is shown in FIGS. 3 and 4.

All of the hydraulic jacks 8 of a long recessible guide rail can be actuated by actuation means in the form of a conduit 10 supplied by a hydraulic pump. The conduit 10 can be placed in the recess 11.

Figure 4:
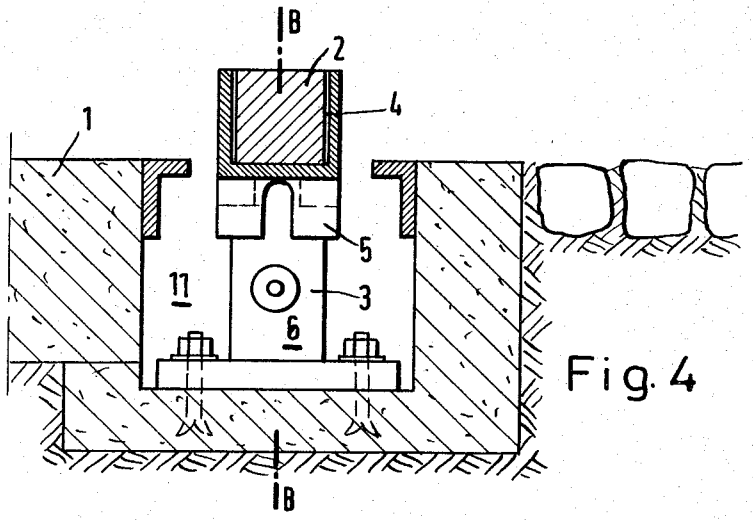
FIG. 4 is a lateral section view of the recessible guide rail taken along line A—A of FIG. 3.
Figure 3:
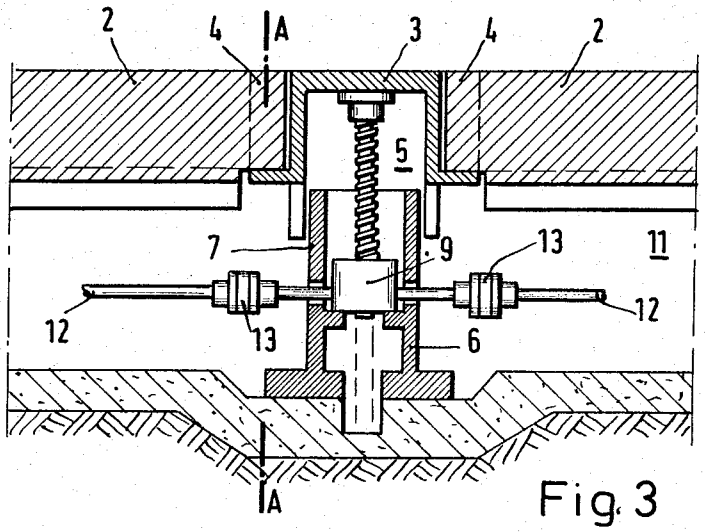
FIG. 3 is a longitudinal section view of the recessible guide rail of FIG. 1 with the guide rail shown in the elevated position, the section view being taken along line B—B of FIG. 4.

If desired, other elevation means can be used as, for example, the threaded drive 9 shown in FIGS. 3 and 4. A single drive motor could actuate all of the threaded drives 9 with a shaft 12 and an elastic coupling 13 which interconnect the drives 9.

The horizontal forces which act on the recessible guide rail in its raised position and the vertical forces which act thereon in its recessed position are all taken up by the supporting device 3 and are directed via the base 6 thereof to the foundation means upon which the base is securely mounted. The foundation means can be part of the roadway structure or, a special foundation can be provided at the bottom of the recess.

Figure 5:
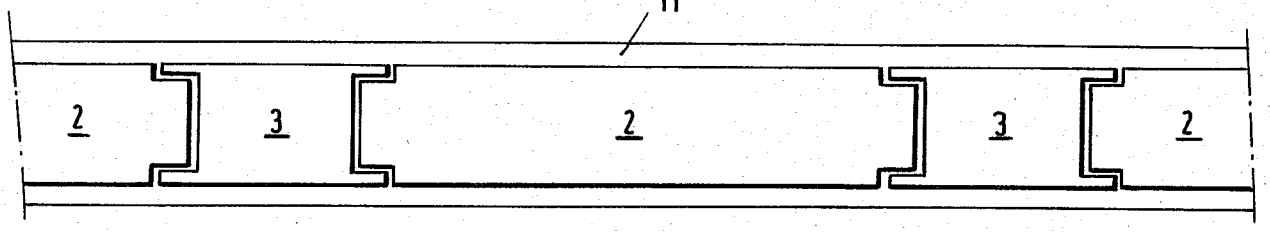
FIG. 5 is a plan view of a straight length of a recessible guide rail of the invention.
Figure 4A:
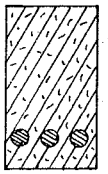
FIG. 4*a* is a section view of a guide rail segment showing how the latter can be reinforced with steel.

FIG. 5 shows a straight length of the recessible guide rail made up of a plurality of guide rail segments arranged one behind the other. The guide rail segments can be made of steel-reinforced concrete as shown in FIG. 4*a*.

Figure 6:
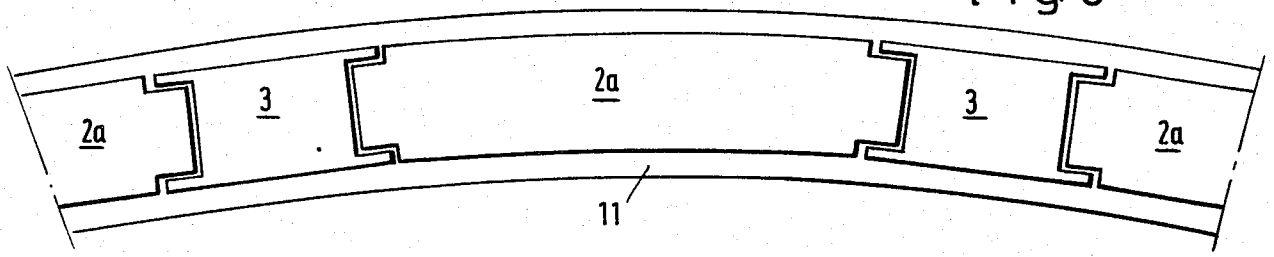
FIG. 6 is a plan view of a curved length of a recessible guide rail of the invention.

FIG. 6 shows how the recessible guide rail can be assembled to achieve any desired run with arcuate guide rail segments 2*a* and the supporting devices 3 incorporating appropriate elevation means. In this way, the recessible guide rail arrangement of the invention can be used to build guide rail switches.

It is understood that the foregoing description is that of the preferred embodiments of the invention and that various changes and modifications may be made thereto without departing from the spirit and scope of the invention, as defined in the appended claims.

What is claimed is:

1. A recessible guide rail arrangement for guiding a wheel-supported vehicle in its movement along a roadway structure, the vehicle having flangeless wheels or the like for coacting with a side wall of the rail to laterally guide the vehicle along the roadway structure, the recessible guide rail arrangement comprising:

a plurality of guide rail segments arranged one behind the other to define the guide rail, the ends of each two mutually adjacent segments defining supporting locations of the guide rail;

a recess extending in the direction of travel on the roadway structure; and a plurality of supporting devices mounted in said recess and arranged at respective ones of said locations along the guide rail, said supporting devices including holding means for receiving the respective end portions of the mutually adjacent segments therein to thereby hold and support said segments with respect to the roadway structure;

said supporting devices including elevation means for moving said guide rail between a first position whereat said guide rail is recessed in said recess and a second position whereat the guide rail is raised above the roadway surface for laterally guiding the vehicle therealong.

2. A recessible guide rail arrangement for guiding a vehicle in its movement along a roadway structure that is intersected at grade level by a conventional road carrying motorized traffic, the vehicle having means for coacting with a vertical side wall of the rail to laterally guide the vehicle along the roadway structure, the recessible guide rail arrangement comprising:

a plurality of rail segments having respective lengths selected to accommodate the dimensional requirements of the roadway structure, the segments being arranged one behind the other to define the guide rail and the ends of each two mutually adjacent segments defining supporting locations of the guide rail;

an elongated recess at least at the conventional road crossing and extending in the direction of travel of said roadway structure; and a plurality of supporting devices arranged in said recess at respective ones of said locations along the guide rail, each of the supporting devices including:

a base;

holding means mounted on said base for receiving the respective end portions of the mutually adjacent segments therein and supporting the segments with respect to the roadway structure; and elevation means for moving said guide rail between a first position whereat the guide rail is recessed in said recess so as to be flush with respect to the roadway surface and a second position whereat the guide rail is raised above the roadway surface of said roadway structure for laterally guiding the vehicle thereon.

3. The recessible guide rail arrangement of claim 2, said recess being formed in said roadway structure; and said base being firmly secured to said roadway structure in said recess whereby the load of the motorized traffic on said recessed guide rail is transferred to said roadway structure when the guide rail is in said first position and whereby the lateral load of the guided vehicle on the guide rail is likewise transferred to the roadway structure when said guide rail is in said second position.

4. The recessible guide rail arrangement of claim 3, said holding means including a structure defining two lateral pockets for receiving respective ones of the end portions of the mutually adjacent segments.

5. The recessible guide rail arrangement of claim 4, said lateral pockets having respective upwardly facing openings whereby said rail segments can be drop-loaded thereinto from above.

6. The recessible guide rail arrangement of claim 4 wherein: at least a portion of said rail segments have a predetermined curvature, said pockets being adapted to receive said curved segments.

7. The recessible guide rail arrangement of claim 4 wherein: at least a portion of said segments having a vertical side wall exhibiting a predetermined curvature in the direction of travel of the vehicle, said pockets being adapted to receive said last mentioned segments.

8. The recessible guide rail arrangement of claim 4, said rail segments being made of reinforced concrete.

9. The recessible guide rail arrangement of claim 3 comprising: foundation means disposed at the bottom of said recess; said base being firmly secured to said foundation means whereby the load of the motorized traffic on said recessed guide rail is transferred to said foundation means when the guide rail is in said first position and whereby the lateral load of the guided vehicle on the guide rail is likewise transferred to said foundation means when said guide rail is in said second position.

10. A recessible guide rail arrangement for guiding a vehicle in its movement along a roadway structure, the vehicle having flangeless wheels or the like for coacting with a vertical side wall of the guide rail to laterally guide the vehicle along the roadway structure, the recessible guide rail arrangement comprising:

a plurality of rail segments having respective lengths selected to accommodate the dimensional requirements of the roadway structure, the rail segments being arranged one behind the other to define the guide rail and the ends of each two mutually adjacent segments defining the supporting locations of the guide rail;

an elongated recess extending in the direction of travel of the roadway structure;

foundation means disposed at the bottom of said recess; and a plurality of supporting devices arranged in said recess at respective ones of said locations along the guide rail, each of the supporting devices including: a base fixedly mounted to said foundation means; holding means mounted on said base for receiving the respective end portions of the mutually adjacent segments therein and supporting the segments with respect to the roadway structure; and elevation means for moving said guide rail between a first position whereat the guide rail is recessed in said recess so as to be flush with respect to the roadway surface and a second position whereat the guide rail is raised above the roadway surface of said roadway structure for laterally guiding the vehicle thereon; and actuation means interconnecting said elevation means for simultaneously actuating the same for moving said guide rail between said first and second positions.

11. The recessible guide rail arrangement of claim 10, said holding means including a structure defining two lateral pockets for receiving respective ones of the end portions of the mutually adjacent rail segments, said lateral pockets having respective upwardly facing openings whereby said rail segments can be drop-loaded thereinto from above.

* * * * *

UNITED STATES PATENT AND TRADEMARK OFFICE

CERTIFICATE OF CORRECTION

PATENT NO. : 4,538,521

DATED : September 3, 1985

INVENTOR(S) : Werner Fastenau

It is certified that error appears in the above-identified patent and that said Letters Patent is hereby corrected as shown below:

In column 2, line 68: delete the comma after the word "side".

Signed and Sealed this

*Thirteenth* Day of *May 1986*

[SEAL]

*Attest:*

DONALD J. QUIGG

*Attesting Officer*

*Commissioner of Patents and Trademarks*